United States Patent [19]

Brock et al.

[11] 4,096,072

[45] Jun. 20, 1978

[54] FABRIC CONDITIONING COMPOSITIONS

[75] Inventors: John Franklin Brock, Springdale; Kenneth John Schilling, Cincinnati, both of Ohio

[73] Assignee: The Procter & Gamble Company, Cincinnati, Ohio

[21] Appl. No.: 656,218

[22] Filed: Feb. 9, 1976

[51] Int. Cl.[2] ..... D06M 13/46

[52] U.S. Cl. ..... 252/8.8; 8/115.6; 252/8.6

[58] Field of Search ..... 252/8.8 AJ, 8.6, 541; 8/115.6; 428/291; 427/242

[56] References Cited

U.S. PATENT DOCUMENTS

| | | | |
|---|---|---|---|
| 3,242,092 | 3/1966 | Bechtold | 252/8.6 UX |
| 3,366,672 | 1/1968 | Wakeman et al. | 252/8.8 AJ |
| 3,519,562 | 7/1970 | Lanner | 252/8.6 |
| 3,861,870 | 1/1975 | Edwards et al. | 8/115.6 |
| 3,936,537 | 2/1976 | Baskerville et al. | 252/8.8 X |

OTHER PUBLICATIONS

Rose, The Cond. Chem. Dictionary, 7th Ed. 1966, Reinhold Publ. Corp., p. 187.

*Primary Examiner*—William E. Schulz
*Attorney, Agent, or Firm*—Ronald L. Hemingway; Richard C. Witte

[57] ABSTRACT

Fabric conditioning particles comprising a hydrogenated castor oil and a fatty quaternary ammonium salt. These particles are suitable for incorporation into detergent compositions, and adhere to fabric laundered in such compositions. When the laundered fabrics are heated in a clothes dryer, the particles melt and spread uniformly on the fabrics, thus providing a fabric conditioning coating.

17 Claims, No Drawings

FABRIC CONDITIONING COMPOSITIONS

BACKGROUND OF THE INVENTION

The present invention relates to compositions and means for conditioning fabrics. More specifically, certain particulate, water-insoluble, meltable conditioning agents are applied to fabrics, conveniently from an aqueous medium. Thereafter the fabrics are heated in an automatic clothes dryer, whereupon the conditioning agent melts and imparts desirable softening and antistatic benefits. The conditioning agents herein are especially designed for use in the aqueous alkaline media characteristic of pre-soak and laundering liquors and can also be used in aqueous rinse baths.

Fabric "softness" is an expression well defined in the art and is usually understood to be that quality of the treated fabric whereby the handle or texture is smooth, pliable and fluffy to the touch. Moreover, optimally softened fabrics are characterized by a desirable antistatic effect, which is exhibited by a lack of static cling.

It has long been known that various chemical compounds possess the ability to soften and impart antistatic benefits to fabrics. However, the effectiveness of any given compound may depend on its mode of use. For example, rinse-added fabric softeners, especially the quaternary ammonium compounds used in the detergent-free deep rinse cycle of a home laundering operation, provide exceptional conditioning benefits. Unfortunately, the cationic nature of these softeners causes them to interact undesirably with the common anionic surfactants such as the alkyl benzene sulfonates and is generally believed to preclude their use during the deterging cycle of a laundering operation involving commercial anionic detergents.

There has been a continuing search for fabric conditioning agents which are compatible with anionic surfactants and which can be used without regard to the presence or absence of such materials. Much of this work has involved the selection or blending of specific types of cationic conditioners. A few attempts have been made to provide nonionic softeners which, being free from cationic groups, do not interact with anionic surfactants.

Application Ser. No. 520,186, Haug et al., filed Nov. 1, 1974 (now abandoned), discloses detergent compositions containing particles consisting of fatty sorbitan esters having a melting point of from about 38° C. to about 100° C. and mixtures of said sorbitan esters with fatty quaternary ammonium salts. The particles adhere to fabrics washed in the detergent composition and melt to form a fabric conditioning coating on the fabrics when they are subsequently heated in a dryer.

It has been found that the compositions of Ser. No. 520,186 provide excellent fabric conditioning performance; however, in the early part of the drying cycle in a heated dryer, before melting of the particles occurs, some of the particles become separated from the fabrics due to the tumbling action of the dryer and these particles are carried by the moving air stream of the dryer into the dryer exhaust system where they can cause a clogging problem on the lint screen.

Application Ser. No. 624,032, Schilling, filed Oct. 20, 1975, and now abandoned, discloses detergent compositions containing particles prepared from a mixture of fatty sorbitan ester, a quaternary ammonium softener and polyethylene glycol. These particles diminish the lint screen clogging problem encountered with the particles described in Ser. No. 520,186.

It is the primary object of the present invention to provide fabric conditioning particles for use in detergent compositions, which particles exhibit high adhesion to fabrics in the dryer and thereby minimize the problem of softener loss through the dryer exhaust system and clogging of lint screens and also provide improved fabric softening and antistatic benefits compared to previously known particles used for this purpose.

SUMMARY OF THE INVENTION

The present invention is based upon the discovery that fabric conditioning particles prepared from certain mixtures of hydrogenated castor oil and quaternary ammonium salt fabric conditioning agents have a soft consistency in a detergent-containing laundering solution, thereby facilitating "smearing" of the particles onto fabrics which come into contact with said particles in the solution. As a result, the particles exhibit a high degree of adhesion to the fabrics when tumbled in a laundry dryer. Under the typical heating and tumbling conditions in the dryer the hydrogenated castor oil/-quaternary ammmonium salt composition becomes evenly spread over the fabrics. The dried fabrics exhibit excellent softness and very low static charge.

DETAILED DESCRIPTION OF THE INVENTION

The present invention in its broadest aspect relates to fabric conditioning particles which are useful as adjuvants for detergent compositions. The invention also relates to detergent compositions containing said particles and to methods of conditioning fabrics by treating the fabrics with the detergent compositions, followed by drying in a heated dryer.

The fabric conditioning particles of the present invention have a particle size diameter of from about 5 microns to about 2000 microns and consist essentially of the following components:

1. From about 20% to about 55% of hydrogenated castor oil having an iodine value of less than 20, and
2. From about 45% to about 80% of a quaternary ammonium salt fabric conditioning compound.

The preferred levels of Components 1 and 2 in the particles of this invention are, respectively, 30% to 45% and 55% to 70%. A particularly preferred composition consists essentially of from about 35% to about 40% of Component 1 and from about 55% to 60% of Component 2. All percentages herein are by weight unless specified otherwise.

Particles of the foregoing type, especially when formulated into compositions with an effective amount of a bleach such as perborate and detersive enzymes, are particularly useful as laundry pre-soaks; or such compositions can be added to any detergent composition to provide both additional detergency builder action and the fabric conditioning benefits of the hydrogenated castor oil/quaternary ammonium salt combination. Moreover, the particles will give good adhesion to the fabrics treated in the laundering composition so that said particles will have a high tendency to stay attached to the fabrics in the dryer. In addition to high adhesion to fabrics, the fabric conditioning particles herein are hard in the dry state, thus making them convenient to handle. The particles have extremely low water solubility, thus giving good carry-over of the fabric conditioning agents from the washing process to the drying process. This is especially important under hot water washing conditions (e.g., about 50° C) where particles having higher solubility or lower melting points give poorer carry-over.

Inasmuch as the particles herein are wholly compatible with all manner of detersive surfactants and builders, even under alkaline conditions, the present invention also encompasses detergent compositions especially adapted for concurrently cleansing and imparting conditioning benefits to fabrics comprising an effective amount of the fabric conditioning particles as disclosed hereinabove and an effective amount of a detergency builder and/or a surfactant.

Finally, the present invention encompasses a process for conditioning fabrics comprising the steps of contacting said fabrics with an effective amount of the fabric conditioning particles described herein and thereafter subjecting the fabrics to an elevated temperature within the range of from about 38° C. to about 120° C. Treatment of the fabrics at the elevated temperature is conveniently and preferably carried out in an automatic clothes dryer concurrently with a standard laundry drying operation.

The term "effective amount" as used hereinabove to describe the amount of fabric conditioning particles, builder, detersive surfactant, etc., in the compositions and processes of this invention is intended to mean that amount of the respective materials which will perform their corresponding functions. The amount used in a given situation will vary somewhat, depending on the desires of the formulator and other considerations described more fully hereinafter.

The particles herein consist essentially of ingredients which are described individually, as follows:

HYDROGENATED CASTOR OIL

Castor oil is a naturally occurring triglyceride obtained from the seeds of *Ricinus Communis,* a plant which grows in most tropical or subtropical areas. The primary fatty acid moiety in the castor oil triglyceride is ricinoleic acid (12-hydroxy oleic acid). It accounts for about 90% of the fatty acid moieties. The balance consists of dihydroxystearic, palmitic, stearic, oleic, linoleic, linolenic and eicosanoic moieties. Hydrogenation of the oil (e.g., by hydrogen under pressure) converts the double bonds in the fatty acid moieties to single bonds, thus "hardening" the oil. The hydroxyl groups are unaffected by this reaction. The resulting hydrogenated castor oil, therefore, has an average of about three hydroxyl groups per molecule. It is believed that the presence of these hydroxyl groups accounts in large part for the outstanding anti-static properties which are imparted to fabrics treated with the compositions described herein, compared to similar compositions which contain triglycerides which do not contain hydroxyl groups in their fatty acid chains.

For use in the compositions of the present invention the castor oil should be hydrogenated to an iodine value of less than about 20, and preferably less than about 10. Iodine value is a measure of the degree of unsaturation of the oil and is measured by the "Wijis Method," which is well known in the art. Unhydrogenated castor oil has an iodine value of from about 80 to 90.

Hydrogenated castor oil is a commercially available commodity, being sold, for example, in various grades under the trademark CASTORWAX® by NL Industries, Inc., Highstown, New Jersey.

CATIONIC FABRIC CONDITIONING AGENT

The cationic component of the fabric conditioning particles herein can comprise any of the cationic (including imidazolinium) compounds generally used in the fabric conditioning art.

Examples of such compounds are:

(a) Compounds of the formula $[RR_1R_2R_3N]^+ X^-$ wherein R and $R_1$ represent benzyl or an alkyl containing from 1 to 3 carbon atoms, $R_2$ represents benzyl or an alkyl containing from 1 to 3 carbon atoms or an alkyl of from 12 to 20 carbon atoms or alkoxypropyl or hydroxy substituted alkoxypropyl radicals wherein the alkoxy contains 12 to 20 carbon atoms, $R_3$ represents an alkyl containing from 12 to 20 carbon atoms and X is a salt-forming anion such as, for example, chloride, bromide, nitrate, bisulfate, acetate, methylsulfate or ethylsulfate.

(b) Cationic quaternary imidazolinium compounds having the formula

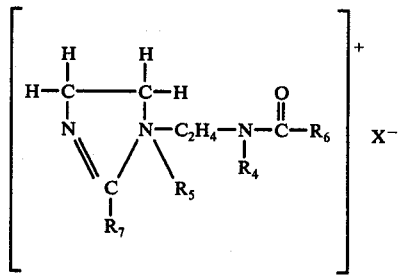

wherein $R_5$ is an alkyl containing from 1 to 4, preferably 1 to 2 carbon atoms, $R_6$ is an alkyl containing from 8 to 25 carbon atoms or a hydrogen radical, $R_7$ is an alkyl containing from 8 to 25, preferably at least 15, carbon atoms, $R_4$ is hydrogen or an alkyl containing from 1 to 25, preferably at least 15 carbon atoms and X is an anion as described in (a) above.

(c) Alkyl ($C_{12}$ to $C_{20}$) pyridinium salts wherein the salt forming anion is as in (a) above.

(d) Alkyl ($C_{12}$ to $C_{20}$) — alkyl ($C_1$–$C_2$) morpholinium salts wherein the salt forming anion is as in (a) above.

The preferred anions for the quaternary ammonium fabric softener salts are chloride and methylsulfate. The most preferred anion is methylsulfate.

Examplary quaternary ammonium fabric conditioning compounds are dodecyltrimethylammonium chloride,
didodecyldimethylammonium methylsulfate,
didodecyldipropylammonium ethylsulfate,
ditallowdiethylammonium methylsulfate,
ditallowdimethylammonium chloride,
tallowdimethylbenzylammonium nitrate,
ditallowdimethylammonium methylsulfate,
ditallowdimethylammonium bisulfate,
Methyl(1)octadecylamidoethyl(2)octadecyl imidazolinium methylsulfate,
methyl(1)dodecylamidoethyl(2)dodecyl imidazolinium chloride,
tallowpyridinium methylsulfate, dodecylpyridinium chloride,
dodecylmethylmorpholinium acetate, and
tallowethylmorpholinium bromide.

Other exemplary quaternary ammonium salt fabric conditioning compounds suitable for use herein are disclosed in U.S. Pat. No. 3,686,025, Morton, issued Aug. 22, 1972.

The preferred quaternary ammonium salt fabric conditioning compounds for use herein are ditallowdimethylammonium methylsulfate, ditallowdimethylammonium chloride, methyl(1)stearylamidoethyl(2)-stearylimidazolinium methosulfate and methyl(1)-stearylamidoethyl(2)stearylimidazolinium chloride. The most preferred quaternary ammonium salt fabric conditioning compound is ditallowdimethylammonium methylsulfate.

The fabric conditioning particles of the present invention can be conveniently prepared by co-melting the hydrogenated castor oil and quaternary ammonium salt fabric conditioning compound and then converting the molten mass into particles of the desired size by any of the conventional means for converting melted materials to dry particles, e.g., cooling to a solid mass, followed by grinding to the appropriate size, or simultaneously cooling the mass and forming particles by spraying the mass through a nozzle into a cool atmosphere. Particle size selection can be accomplished by screening, airstream segregation, etc.

PARTICLE SIZE

The fabric conditioning particles employed herein are in the form of substantially water-insoluble particles having an average size (diameter) range of from about 5 microns ($\mu$) to about 2,000$\mu$. Preferably, the particle size of the particles herein lies in the range from about 50$\mu$ to about 200$\mu$, and particles within this range are efficiently entrained on fabric surfaces and are not particularly noticeable on the fabrics. Of course, after melting in a dryer, no particles are seen.

In addition to the two essential components, the particles herein can contain minor amounts of other fabric treating agents; e.g., perfumes can be present in the particles at levels of from about 0.1% to about 2%; fabric brighteners, such as Tinopal RBS and Tinopal TAS (trademarks of Ciba-Geigy Company) can be present at levels from about 0.1% to about 2%; antibacterial agents such as 3'4'5-trichlorosalicyanilide and Hexachlorophene can also be present at levels of from about 0.1% to 2%.

DETERGENT COMPOSITIONS

The fabric conditioning particles herein are preferably formulated into dry granular detergent compositions at a level of from about 1% to about 30% (preferably about 5% to about 20%) of the composition. Such compositions generally contain as an essential component a detergency builder salt, but may also contain such conventional detergent composition components as surfactants, bleaches and additional adjuncts such as brighteners, soil-suspending agents, etc.

All manner of detergency builders can be used in the compositions herein. The compositions herein generally contain from about 5% to about 95% by weight, preferably from about 15% to about 65% by weight, of said builders. Useful builders herein include any of the conventional inorganic and organic water-soluble builder salts, as well as the various water-insoluble and so-called "seeded" builders.

Inorganic detergency builders useful herein include, for example, water-soluble salts of phosphates, pyrophosphates, orthophosphates, polyphosphates, phosphonates, carbonates, and silicates. Specific examples of inorganic phosphate builders include sodium and potassium tripolyphosphates, phosphates, and hexametaphosphates. The polyphosphonates specifically include, for example, the sodium and potassium salts of ethylene diphosphonic acid, the sodium and potassium salts of ethane 1-hydroxy-1,1-diphosphonic acid, and the sodium and potassium salts of ethane-1,1,2-triphosphonic acid. Examples of these and other phosphorus builder compounds are disclosed in U.S. Pat. Nos. 3,159,581; 3,213,030; 3,422,137; 3,400,176 and 3,400,148, incorporated herein be reference. Sodium tripolyphosphate is an especially preferred, water-soluble inorganic builder herein.

Nonphosphorus containing sequestrants can also be selected for use herein as detergency builders.

Specific examples of nonphosphorus, inorganic builder ingredients include water-soluble inorganic carbonate, bicarbonate, and silicate salts. The alkali metal, e.g., sodium and potassium, carbonates, bicarbonates and silicates are particularly useful herein.

Water-soluble, organic builders are also useful herein. For example, the alkali metal, ammonium and substituted ammonium polyacetates, carboxylates, polycarboxylates, succinates, and polyhydroxysulfonates are useful builders in the present compositions and processes. Specific examples of the polyacetate and polycarboxylate builder salts include sodium, potassium, lithium, ammonium and substituted ammonium salts of ethylene diamine tetraacetic acid, nitrilotriacetic acid, oxydisuccinic acid, mellitic acid, benzene polycarboxylic acids, and citric acid.

Highly preferred nonphosphorus builder materials (both organic and inorganic) herein include sodium carbonate, sodium bicarbonate, sodium silicate, sodium citrate, sodium oxydisuccinate, sodium mellitate, sodium nitrilotriacetate, and sodium ethylenediaminetetraacetate, and mixtures thereof.

An extensive disclosure of additional detergency builders and builder systems is present in U.S. Ser. No. 520,186, Haug et al., cited supra which is incorporated by reference herein.

Water-soluble surfactants, when used in the present compositions, are present at levels of from about 0.5% to about 50% and include any of the common anionic, nonionic, ampholytic and zwitterionic detersive agents well known in the detergency arts. Mixtures of surfactants can also be employed herein. More particularly, the surfactants listed in U.S. Pat. Nos. 3,717,630, Booth, Feb. 20, 1973, and 3,332,880, Kessler et al., July 25, 1967, each incorporated herein by reference, can be used herein. Nonlimiting examples of surfactants suitable for use in the instant compositions and processes are as follows.

Water-soluble salts of the higher fatty acids, i.e., "soaps," are useful as the anionic surfactant herein. This class of surfactants includes ordinary alkali metal soaps such as the sodium, potassium, ammonium and alkanolammonium salts of higher fatty acids containing from about 8 to about 24 carbon atoms and preferably from about 10 to about 20 carbon atoms. Soaps can be made by direct saponification of fats and oils or by the neutralization of free fatty acids. Particularly useful are the sodium and potassium salts of the mixtures of fatty acids derived from coconut oil and tallow, i.e., sodium or potassium tallow and coconut soaps.

Another class of anionic surfactants includes water-soluble salts, particularly the alkali metal, ammonium and alkanolammonium salts, or organic sulfuric reaction products having in their molecular structure an alkyl group containing from about 8 to about 22 carbon atoms and a sulfonic acid or sulfuric acid ester group. (Included in the term "alkyl" is the alkyl portion of acyl groups.) Examples of this group of synthetic surfactants which can be used in the present invention are the sodium and potassium alkyl sulfates, especially those obtained by sulfating the higher alcohols ($C_8$–$C_{18}$ carbon atoms) produced by reducing the glycerides of tallow or coconut oil; and sodium and potassium alkyl benzene sulfonates, in which the alkyl group contains from about 9 to about 15 carbon atoms in straight chain or branched chain configuration, e.g., those of the type described in U.S. Pat. Nos. 2,220,099 and 2,477,383, incorporated herein by reference.

Other anionic surfactant compounds herein include the sodium alkyl glyceryl ether sulfonates, especially those ethers of higher alcohols derived from tallow and coconut oil; sodium coconut oil fatty acid monoglyceride sulfonates and sulfates; and sodium or potassium salts of alkyl phenol ethylene oxide ether sulfate containing about 1 to about 10 units of ethylene oxide per molecule and wherein the alkyl groups contain about 8 to about 12 carbon atoms.

Preferred water-soluble anionic organic surfactants herein include linear alkyl benzene sulfonates containing from about 11 to 14 carbon atoms in the alkyl group; the tallow range alkyl sulfates; the coconut range alkyl glyceryl sulfonates; alkyl ether sulfates wherein the alkyl moiety contains from about 14 to 18 carbon atoms and wherein the average degree of ethoxylation varies between 1 and 6; the sulfated condensation products of tallow alcohol with from about 3 to 10 moles of ethylene oxide; olefin sulfonates containing from about 14 to 16 carbon atoms; and soaps, as hereinabove defined.

Specific preferred anionic surfactants for use herein include: sodium linear $C_{10}$–$C_{18}$ alkyl benzene sulfonate; triethanolamine $C_{10}$–$C_{18}$ alkyl benzene sulfonate; sodium tallow alkyl sulfate; sodium coconut alkyl glyceryl ether sulfonate; the sodium salt of a sulfated condensation product of tallow alcohol with from about 3 to about 10 moles of ethylene oxide; and the water-soluble sodium and potassium salts of higher fatty acids containing 8 to 24 carbon atoms.

It is to be recognized that any of the foregoing anionic surfactants can be used separately herein or as mixtures.

Ampholytic surfactants include derivatives of aliphatic or aliphatic derivatives of heterocyclic secondary and tertiary amines in which the aliphatic moiety can be straight chain or branched and wherein one of the aliphatic substituents contains from about 8 to 18 carbon atoms and at least one aliphatic substituent contains an anionic water-solubilizing group.

Zwitterionic surfactants include derivatives of aliphatic quaternary ammonium, phosphonium and sulfonium compounds in which the aliphatic moieties can be straight or branched chain, and wherein one of the aliphatic substituents contains from about 8 to 18 carbon atoms and one contains an anionic water-solubilizing group.

Nonionic surfactants include the water-soluble ethoxylates of $C_{10}$–$C_{20}$ aliphatic alcohols and $C_6$–$C_{12}$ alkyl phenols wherein from about 3 to about 15 moles of ethylene oxide are condensed with each mole of alkyl phenol or aliphatic alcohol. Many nonionic surfactants are especially suitable for use as suds controlling agents in combination with anionic surfactants of the type described herein.

Inasmuch as the fabric conditioning particles are relatively inert to the common pre-soak and detergency adjuncts, any such adjuncts can be used in combination therewith. Representative materials include, for example, the various anticaking agents, filler materials, optical brighteners, antispotting agents, dyes, perfumes and the like. These adjunct materials are commonly used as minor components (e.g., 0.1% to 5% wt.) in compositions of the present type.

Highly preferred additives herein include various bleaches commonly employed in pre-soak, laundry additive and detergent compositions. Such bleaches can include, for example, the various organic peroxyacids such as peradipic acid, perphthalic acid, diperphthalic acid and the like. Inorganic bleaches, including such materials as sodium perborate, sodium perborate tetrahydrate, urea peroxide, potassium dichlorocyanurate, sodium dichlorocyanurate dihydrate and the like, can be employed in the compositions herein. Bleaches are commonly used in laundering compositions at a level of from about 1% to about 45% by weight.

An especially preferred bleaching agent for use herein is sodium perborate tetrahydrate, at an effective concentration of from about 5% to about 30% by weight of the total composition.

Various detergency enzymes well known in the art for their ability to degrade and aid in the removal of various soils and stains can also be employed in the present compositions and processes. Detergency enzymes are commonly used at concentrations of from about 0.1% to about 1.0% by weight of such compositions. Typical enzymes include the various proteases, lipases, amylases and mixtures thereof, which are designed to remove a variety of soils and stains from fabrics.

The detergent compositions herein are prepared by simply dry-blending the various ingredients in the desired proportions and concentrations. The compositions are conveniently prepared to provide effective amounts of the various ingredients in an aqueous liquor designed for treating fabrics. The amount of the individual ingredient will vary somewhat, according to the desires of the user and other factors such as fabric type, water temperature, water hardness, soil load and the like. Moreover, the compositions are preferably formulated so that they are easy to measure and pour according to the established habits and practices of most users.

Typical pre-soak compositions herein are designed to provide a detergency builder level of from about 50 ppm to about 1,000 ppm, preferably 100 ppm to 500 ppm in an aqueous laundering liquor (5–25 gallons).

Typical laundry detergent compositions are designed to provide a concentration of builder within the above-recited range, and a concentration of detersive surfactant in the range from about 50 ppm to about 500 ppm, more preferably about 15- ppm to about 250 ppm, in an aqueous solution (5–25 gallons).

The fabric conditioning particles herein are preferably employed at a concentration of about 10 ppm to about 500 ppm, more preferably from about 50 ppm to about 150 ppm in an aqueous liquor, either as a pre-soak or in a laundering liquor.

As can be seen from the foregoing, compositions prepared in the manner of the present invention can contain the various ingredients and components over a wide compositional range. The user of compositions herein can simply adjust usage levels to obtain the desired, effective amount in the laundry bath.

When formulating compositions designed for use at the ca. ¼ cup to 1½ cup usage level familiar to most users of laundry products, the following typical concentration ranges of the various ingredients can be employed.

A typical fabric pre-soak composition prepared in the manner of this invention will comprise from about 1% to about 25%, more preferably from about 3% to about 15%, by weight of the fabric conditioning particles; from about 10% to about 80%, more preferably from about 20% to about 60%, by weight of a detergency builder; from about 5% to about 45%, more preferably from about 10% to about 30%, by weight of a bleach; and from about 0.05% to about 2.0%, more preferably from about 0.1% to about 1.0%, by weight of a detergency enzyme.

Detergent compositions prepared in the manner of this invention will comprise from about 1% to about 25%, more preferably from about 3% to about 15%, by weight of the fabric conditioning particles, and from about 1% to about 50%, more preferably from about 3% to about 15%, by weight of a detersive surfactant. The balance of such detergent compositions will comprise, for example, inert fillers. More preferably, the detergent compositions will be built, and comprise, as an additional component, from about 15% to about 65%, more preferably from about 20% to about 50%, by weight of a detergency builder.

In use, the aforesaid compositions provide a process for conditioning fabrics which comprises the steps of (1) contacting said fabrics with an effective amount (as set forth above) of the fabric conditioning particles in an aqueous laundering medium having a temperature below about 52° C (preferably from about 30° C to about 46° C) concurrently with a pre-soaking or detergent operation, and (2) drying said fabrics in an automatic clothes dryer at a temperature of from about 38° C to about 120° C. Optionally, and preferably, the fabrics are rinsed in water prior to drying them in a dryer. The temperature of the aqueous solution should be below about 52° C to prevent the particles from melting in the solution. Preferably the aqueous solution temperature is from about 20° C to about 46° C, most preferably from about 30° C to 40° C. When a rinse is used, the rinse water temperature should also be below about 52° C, and preferably below 40° C.

The invention will be further illustrated by the following examples:

EXAMPLE I

This example illustrates the preparation of particles of the present invention. The hydrogenated castor oil used is a commercial material sold under the name CASTORWAX® BY NL Industries and has an iodine value of 3.

400 grams of the hydrogenated castor oil and 600 grams ditallowdimethylammonium methylsulfate are melted together at a temperature of 90° C and stirred to form a homogeneous mass. The molten mixture is sprayed through a nozzle at a pressure of 1000 psi into an atmosphere having a temperature of about 13° C to form solid particles. The particles are then screened to obtain the fraction having a particle size between 50μ and 150μ.

EXAMPLE II

A laundry pre-soak and detergent additive composition is prepared according to the following formula:

| Ingredient | Weight % |
|---|---|
| Particles of Example I | 20.0 |
| Sodium tripolyphosphate | 27.5 |
| Sodium perborate tetrahydrate | 5.0 |
| Borax | 11.7 |
| $TAE_{20}$[1] | 0.8 |
| Spray dried detergent granules[2] | 34.4 |
| Enzyme[3] | 0.3 |
| Perfume | 0.3 |
| | 100.0 |

[1]Tallow alcohol ethoxylated with 20 moles of ethylene oxide per mole of alcohol.
[2]Granules consisting of 10% linear alkylbenzene sulfonate, 20% sodium carbonate 20% sodium silicate, balance sodium sulfate and water.
[3]Alkalase (Novoindustrie) and protease (Miles Laboratories).

The dry ingredients are blended together with the fabric conditioning particles. The perfume is dissolved in the $TAE_{20}$ and this mixture is sprayed onto the dry mixture to produce a dry, free-flowing, nondusty product.

A load of cotton and synthetic fabrics are soaked for one hour in an automatic washing machine containing 60 grams of the above composition in 64 liters of water at a temperature of 27° C. The soak water is then spun out, and the machine is again filled with water at 38° C. and 95 grams of a commercial laundry detergent are added. After the machine has completed the normal washing and rinsing cycle the fabrics are placed in a dryer and tumbled at a temperature of about 95° C. until dry. The fabrics are softer and the synthetic fabrics exhibit a lower static charge than fabrics treated in a similar manner, but without the fabric conditioning particles being present in the pre-wash soak.

Repeated usage of the above composition results in less clogging of dryer lint screens than with a composition containing the particles described in Haug Ser. No. 520,186, filed Nov. 1, 1974, now abandoned.

EXAMPLE III

A laundry detergent is prepared according to the following formula:

| Ingredient | Weight % |
|---|---|
| Particles of Example I | 15 |
| Detergent granules (spray dried) | 85 |
| Linear alkylbenzene sulfonate | 20 |
| Sodium tripolyphosphate | 50 |
| Sodium silicate solids | 7 |
| Sodium sulfate | 10 |
| Fabric brightener | 0.3 |
| Sodium carboxymethylcellulose | 1.0 |
| Perfume | 0.2 |
| Water and Miscellaneous to | 100.0 |
| | 100.0 |

The composition is prepared by mixing the granules and the fabric conditioning particles. Fabrics laundered in this composition at 35° C. and dried in a dryer at 95° C. exhibit excellent softness and low static charge. Buildup of the fabric softener ingredients on the lint screen of the dryer upon repeated usage of the product is less than with a product containing the particles of Haug Ser. No. 520,186, filed Nov. 1, 1974, now abandoned.

When the above detergent is prepared with particles made according to the procedure of Example I wherein the following quaternary ammonium salts are substituted on an equal weight basis for ditallowdimethylammonium methylsulfate, similar softening and anti-static results are obtained; ditallowdimethylammonium chloride, methyl(1)stearylamidoethyl(2)-stearylimidazolinium chloride and methyl(1)-stearylamidoethyl(2)stearylimidazolinium methylsulfate.

EXAMPLE IV

Fabric conditioning particles are prepared according to the procedure of Example I except that 10 grams of perfume are blended into the molten mass before spraying. When these particles are used in the manner exemplified in Example II, a long-lasting residual odor is imparted to the treated fabrics.

What is claimed is:

1. Fabric conditioning particles consisting essentially of 1. from about 20% to about 55% of hydrogenated castor oil having an iodine value of less than about 20, and
2. from about 45% to about 80% of a quaternary ammonium salt fabric conditioning compound wherein said particles have a particle size diameter of from about 5 to about 2000 microns.

2. Particles according to claim 1 wherein the hydrogenated castor oil has an iodine value of less than about 10.

3. The particles of claim 2 wherein the anion in the quaternary ammonium salt fabric conditioning compound is selected from the group consisting of chloride and methylsulfate.

4. The particles of claim 3 wherein the quaternary ammonium salt fabric conditioning compound is selected from the group consisting of ditallowdimethylammonium methylsulfate, ditallowdimethylammonium chloride, methyl(1)stearylamidoethyl(2)-stearylimidazolinium methylsulfate and methyl(1)-stearylamidoethyl(2)stearylimidazolinium chloride.

5. The particles of claim 4 wherein the quaternary ammonium salt fabric conditioning compound is ditallowdimethylammonium methylsulfate.

6. The particles of claim 5 wherein the particle size diameter is from about 50 to about 150 microns.

7. The particles of claim 4 wherein the amount of Component 1 is from about 30% to about 45% and the amount of Component 2 is from about 55% to about 70%.

8. A detergent composition comprising from about 1% to about 30% of the particles of claim 1, and from about 5% to about 95% of a detergency builder.

9. The composition of claim 8 comprising as an additional component from about 0.5% to about 50% of a detergent surfactant selected from the group consisting of anionic, nonionic, ampholytic and zwitterionic surfactants.

10. The composition of claim 9 wherein the hydrogenated castor oil in the said particles has an iodine value of less than about 10.

11. The composition of claim 10 wherein the anion in the quaternary ammonium salt fabric conditioning compound is selected from the group consisting of chloride and methylsulfate.

12. The composition of claim 11 wherein the quaternary ammonium salt fabric conditioning compound is selected from the group consisting of ditallowdimethylammonium methylsulfate, ditallowdimethylammonium chloride, methyl(1)stearylamidoethyl(2)-stearylimidazolinium methylsulfate and methyl(1)-stearylamidoethyl(2)stearylimidazolinium chloride.

13. The composition of claim 12 wherein the quaternary ammonium salt fabric conditioning compound is ditallowdimethylammonium methylsulfate.

14. The composition of claim 13 wherein the particles have a diameter of from about 50 to about 150 microns and the composition contains as an additional ingredient from about 5% to about 30% sodium perborate bleach.

15. The composition of claim 11 wherein in the particles the amount of Component 1 is from about 30% to about 45% and the amount of Component 2 is from about 55% to about 70%.

16. A method of conditioning fabrics comprising the steps of:

(a) contacting said fabrics in an aqueous medium with a concentration of from about 10 to about 500 ppm of the particles of claim 1, at a temperature of from about 20° C to about 52° C, and (b) drying said fabrics in a dryer at a temperature of from about 38° C to about 120° C.

17. The method of claim 16 wherein the particles are the particles having a particle size of from about 50–150 microns.

* * * * *

UNITED STATES PATENT AND TRADEMARK OFFICE

CERTIFICATE OF CORRECTION

PATENT NO. : 4,096,072

DATED : June 20, 1978

INVENTOR(S) : J. F. Brock and K. J. Schilling

It is certified that error appears in the above-identified patent and that said Letters Patent are hereby corrected as shown below:

Col. 10, lines 49-58, the table in Example III should be arranged as follows:

| Ingredient | | Weight % |
|---|---|---|
| Particles of Example I | | 15 |
| Detergent granules (spray dried) | | 85 |
| Linear Alkylbenzene sulfonate | 20 | |
| Sodium tripolyphosphate | 50 | |
| Sodium silicate solids | 7 | |
| Sodium sulfate | 10 | |
| Fabric brightener | 0.3 | |
| Sodium carboxymethylcellulose | 1.0 | |
| Perfume | 0.2 | |
| Water and Miscellaneous | to 100.0 | |
| | | 100.0% |

Signed and Sealed this

*Fifteenth* Day of *May 1979*

[SEAL]

*Attest:*

RUTH C. MASON
*Attesting Officer*

DONALD W. BANNER
*Commissioner of Patents and Trademarks*